United States Patent [19]

Bovitz

[11] Patent Number: 4,979,705

[45] Date of Patent: Dec. 25, 1990

[54] LAUNDRY BAGS AND FRAME APPARATUS

[76] Inventor: Ralph Bovitz, 18132 Medley Dr., Encino, Calif. 91316

[21] Appl. No.: 329,205

[22] Filed: Mar. 27, 1989

[51] Int. Cl.[5] ..... A63B 55/04

[52] U.S. Cl. ..... 248/97; 248/99; 209/937

[58] Field of Search ..... 209/937, 900; 312/328, 312/1; 248/97, 99

[56] References Cited

U.S. PATENT DOCUMENTS

| | | | |
|---|---|---|---|
| 1,214,421 | 1/1917 | Brown | 248/97 |
| 2,625,973 | 1/1953 | Weldon | 248/99 |
| 4,588,154 | 5/1986 | Basore | 248/99 |

FOREIGN PATENT DOCUMENTS

| | | | |
|---|---|---|---|
| 2542222 | 9/1984 | France | 248/99 |

*Primary Examiner*—Kenneth J. Dorner
*Assistant Examiner*—Gerald A. Anderson
*Attorney, Agent, or Firm*—Allan M. Shapiro

[57] ABSTRACT

The demountable frame apparatus has front and back support rails thereon. A plurality of laundry bags each has an open top, closed bottom and continuous sidewalls. The sidewalls have support loops adjacent the open mouth. Two rods support each laundry bag, with a rod going through each support loop. The rods engage upon the support rails and are slidable along the length of the support rails to permit spacing of the plurality of laundry bags, and permit the rods to be moved along the length of the support rails for opening and closing the mouths of the laundry bag and the direct juxtapositioning of the open mouths for ease of laundry sorting. Each of the laundry bags has a carrying handle adjacent its mouth and an emptying handle adjacent its bottom. The rods preferably engage on the support rails in such a way as to prevent the rods from falling off of the support rails by canting of the rods. The frame preferably has a hinged lid and is preferably demountable for compact storage.

5 Claims, 2 Drawing Sheets

FIG. 5
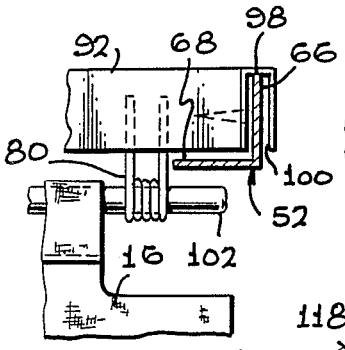
FIG. 6
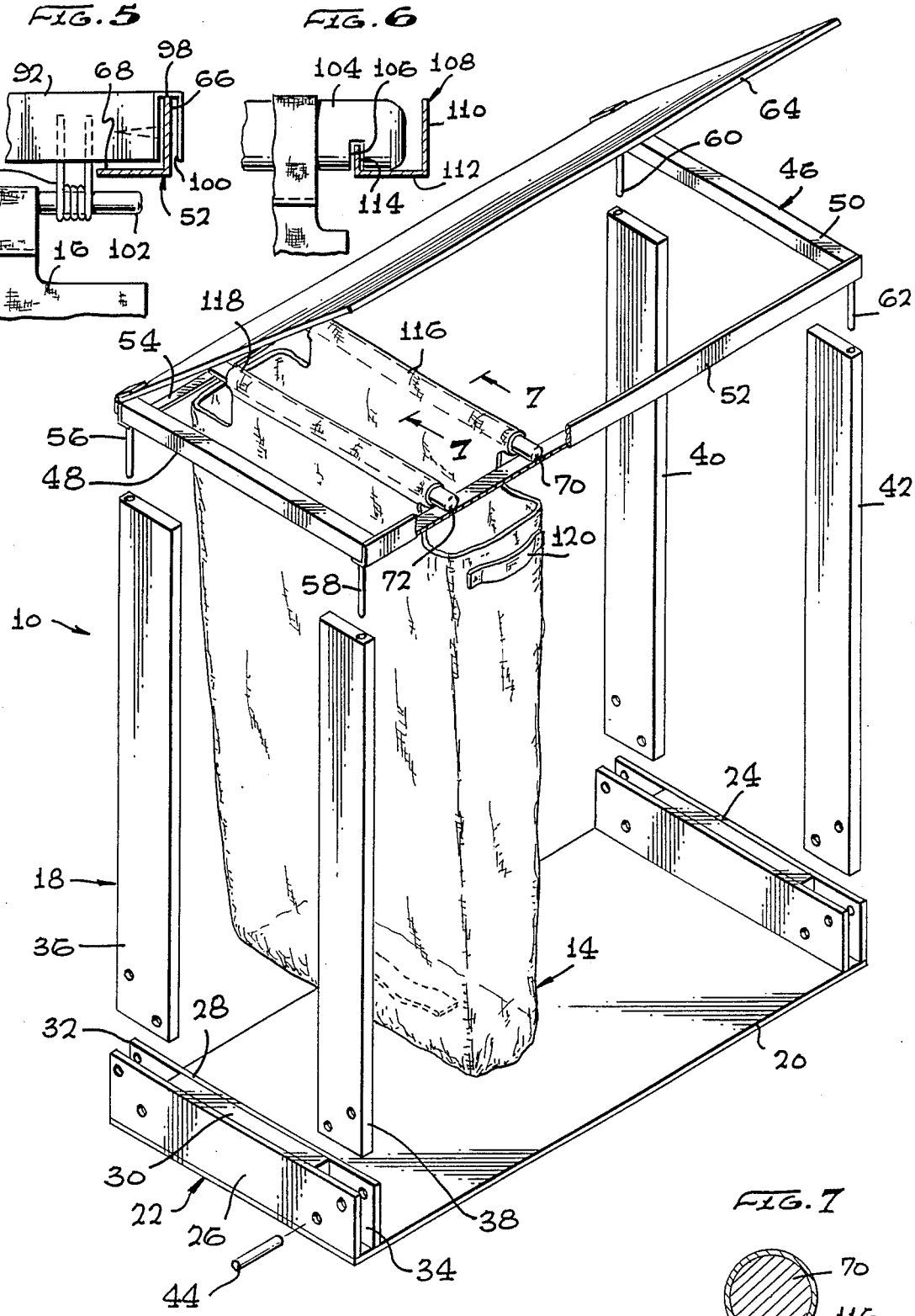
FIG. 1
FIG. 7
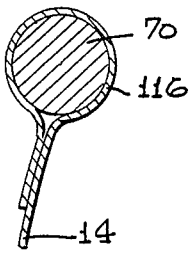

FIG. 2
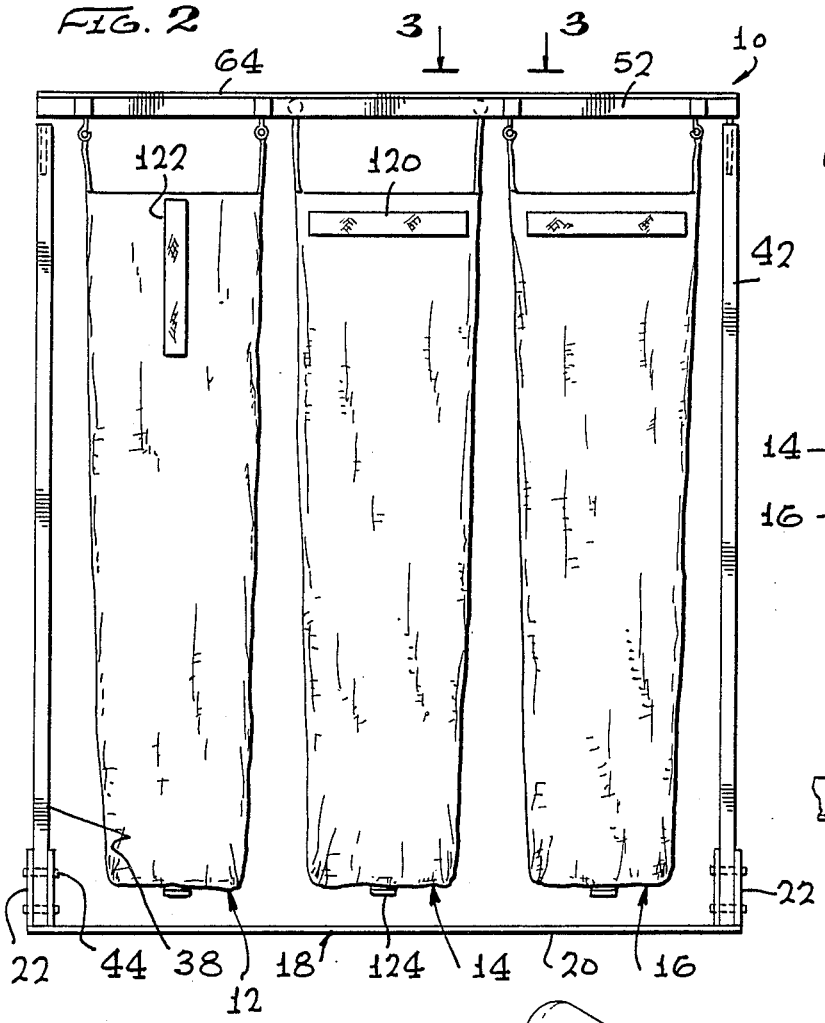
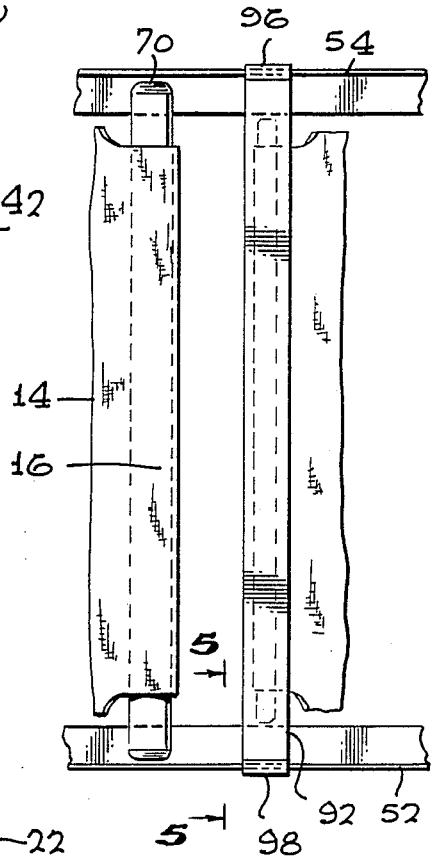
FIG. 3
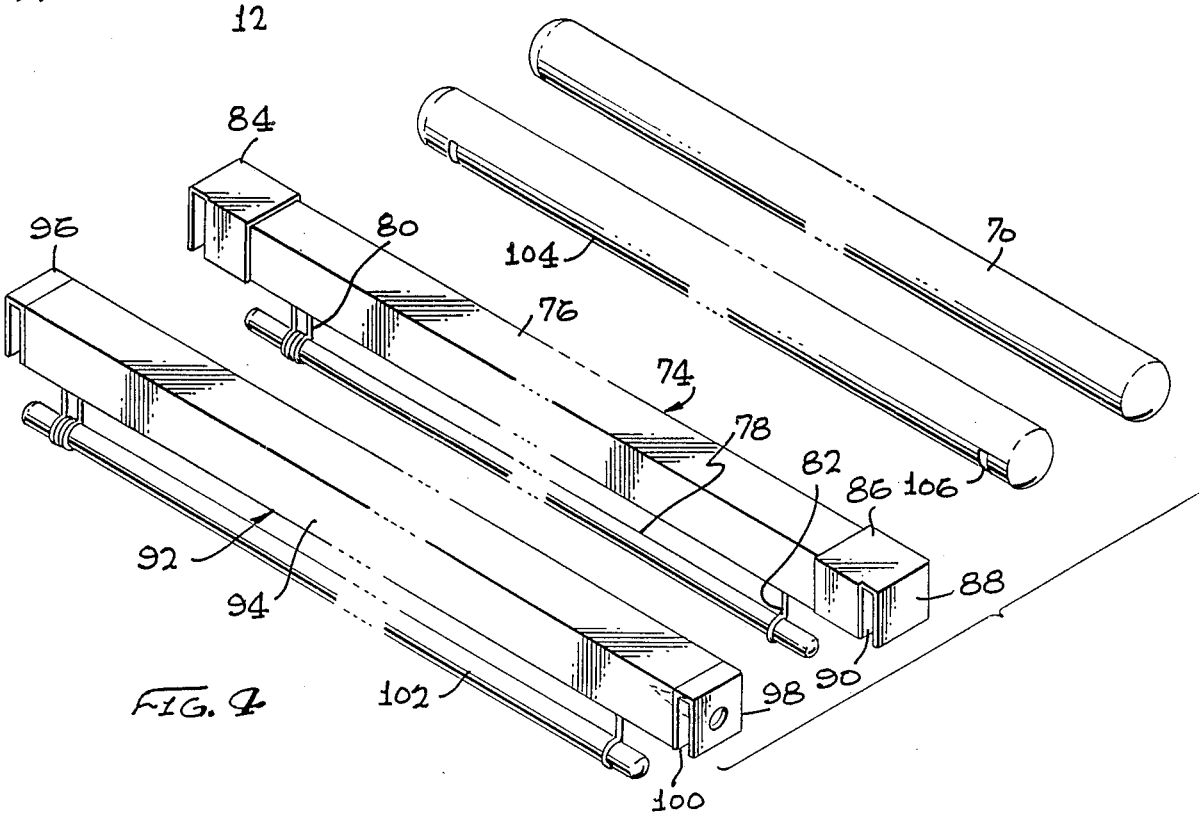
FIG. 4

LAUNDRY BAGS AND FRAME APPARATUS

FIELD OF THE INVENTION

This invention is directed to a plurality of laundry bags and the frame for supporting the laundry bags so that the laundry bags are conveniently held for the sorting of clothes for washing and the storage of the clothes until the bags and their contents are taken to the laundry machine.

BACKGROUND OF THE INVENTION

Those items which need laundering generally fall into the categories of clothing, bedclothes such as sheets and pillow cases, and those items used in personal cleanliness, such as towels and washcloths. These various classes of materials are all fabrics and fall into the very general class of items to be laundered. The items to be laundered are not always immediately laundered, but need to be stored between the time of use and the laundering thereof. In addition, while all of the items to be laundered are made of fabric, they are made of different kinds of fabric and, for maximum life and optimum cleanliness of the items to be laundered, they require different laundering conditions.

The sorting of items to be laundered is well known, but this process and the need for storage of the sorted items is not presently aided by suitable laundry bags and apparatus which ease the sorting and storage of the various laundry items on their way to the washing machine. In addition, it is helpful to provide equipment which is useful to achieve these ends and also to achieve the convenience of moving the sorted items to be laundered to the washing machine.

SUMMARY OF THE INVENTION

In order to aid in the understanding of this invention, it can be stated in essentially summary form that it is directed to laundry bags and frame apparatus wherein a plurality of laundry bags is provided, with each of the bags hanging from a frame so as to permit sorting of the items into the laundry bag. The laundry bags are removably supported in the frame so that the bags can be moved to the laundry machine and emptied therein.

It is thus an object and advantage of this invention to provide a convenient system comprised of laundry bags and supporting frame apparatus which conveniently, compactly and economically provides the necessary equipment for sorting of items to be laundered, compact storage thereof, and easy transport of the bags containing sorted laundry items to the washing machine.

It is another object and advantage of this invention to provide a plurality of laundry bags, each supported adjacent its open mouth and hanging closely together so that laundry may be quickly sorted into the laundry bag, with the laundry bags being demountable so that they can be carried to the laundry machine and emptied therein.

It is a further object and advantage of this invention to provide a plurality of laundry bags which are supported by a frame, with the frame being demountable for ease of storage and shipping and erectable to conveniently support the plurality of laundry bags for the sorting of laundry therein and for the convenient removal of the laundry bags from the frame for emptying of the laundry bags.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

BRIEF DESCRIPTION OF THE DRAWINGS

FIG. 1 is an isometric view of the laundry bag supporting frame of this invention, in exploded position, with parts broken away and parts taken in section, together with one of a plurality of laundry bags hanging therein.

FIG. 2 is a front elevational view of a plurality of laundry bags hanging from the frame apparatus, in accordance with this invention.

FIG. 3 is an enlarged downwardly looking view, with parts broken away, as seen generally along the line 3—3 of FIG. 2.

FIG. 4 is an isometric view showing four different kinds of rods for supporting the laundry bags.

FIG. 5 is an enlarged side-elevational view of the leftmost rod shown in FIG. 4, shown supporting a laundry bag, with parts, broken away.

FIG. 6 is a similar view showing the third rod from the left in FIG. 4 supporting a laundry bag.

FIG. 7 is an enlarged section taken generally along the line 7—7 of FIG. 1.

DESCRIPTION OF THE PREFERRED EMBODIMENTS

The laundry bags and frame apparatus of this invention is generally indicated at 10 in FIGS. 1 and 2 wherein the three bags are generally indicated at 12, 14 and 16 and the frame apparatus is generally indicated at 18.

The frame apparatus 18 is a demountable structure which can be demounted for shipping and storage and can be erected for use. The frame apparatus 18 comprises a floor 20 which has a channel 22 at its left end and a channel 24 at its right end. As best seen in FIG. 1, the channel 22 is formed of outer and inner flanges 26 and 28 which are secured to spacer 30 which is secured to the floor 20 at its right and left ends. Spacer 30 defines pockets 32 and 34 which removably receive the lower ends of uprights 36 and 38. The rear and front uprights 40 and 42 on the right end fit into similar pockets in channel 24. When the lower ends of the uprights are inserted in the pockets, the holes in the channels and in the uprights are in alignment. In this condition, pins are inserted to detachably retain the uprights in place. Pin 44 is illustrated in FIGS. 1 and 2. A similar pin goes into each of the holes to retain the uprights in place.

Rack 46 mounts on the top of the uprights. Rack 46 comprises left and right end rails 48 and 50 and front and back support rails 52 and 54. The rails are fastened in an open rectangular frame with the same lateral dimensions as the floor so that the corners of the frame correspond to the outer corners of the uprights. Pins 56, 58, 60 and 62 are secured to the frame and are directed downwardly at the corners thereof, as seen in FIG. 1. The pins engage in corresponding holes which are directed downwardly from the upper surfaces of the uprights, as seen in FIG. 1. Engagement of the pins in the holes is also shown in FIG. 2, in dashed lines. Cover 64 is shown partly open in FIG. 1 and closed down on the top of the rails of the rack in FIG. 2. As is seen in FIG. 1, cover 64 is hinged to the back rail 54 to permit the cover to lie flat on the top of the rack to cover the bags therein, or to be fully raised for access.

The front and rear rails serve to be engaged by and support the rods which support the bags. The configuration of the front and back support rails is such as to engage and support the bag support rods. The first preferred rail configuration is a simple angle, as seen in FIGS. 1, 3 and 5. These front and back rails have an upright flange 66 and a horizontal flange 68, as seen in FIG. 5. This simple angle support rail can be engaged by and support a number of different rod configurations. Rods 70 and 72 are simple solid wood cylindrical dowels with rounded ends. Rod 70 is seen in FIGS. 1, 3 and 4. These rods are supported by the horizontal flange 68, and the upright flange 66 prevents the downward disengagement of the rod 70 unless it is turned or canted.

In order to prevent unwanted canting, the bagsupporting rods can be configured to engage on the front and back support rails. Rod 74, shown in FIG. 4, is actually an upper rod 76, which engages on and is supported by the front and back support rails, and a lower rod 78, which is engaged by the dependent bag and by which the dependent bag is supported. The rod 74 is employed in pairs the same way as the rods 70 and 72. Lower rod 78 is supported under upper rod 76 by means of spring 80 and hook 82. Spring 80 has two upwardly directed legs which engage into upper rod 76 and are permanently fixed thereto. Spring 80 has a loop between the legs through which the lower end 78 extends. The lower rod 78 may be a wooden dowel or may be a metal rod or tube. The lower rod 78 is permanently engaged in the loop of spring 80, but the spring 80 is sufficiently resilient so that the right end of the lower rod 78 can be laterally moved. In its engaged position, it is engaged in hook 82. It may be resiliently disengaged from hook 82 for access to the now free end of lower rod 78.

Upper rod 74 has caps 84 and 86 thereon. The caps have sockets therein to receive the ends of upper rod 76. The upper rod 76 may be a solid wood rod or it may be a hollow metallic tube. In any event, the caps 84 and 86 are permanently secured thereto. The caps each have a downwardly directed flange, with the near cap 86 showing a downwardly directed flange 88 thereon. The downwardly directed flange defines slot 90 of such size as to engage over the upper flanges, for example upright flange 66 on rail 52. The spacing between the slots in the caps 84 and 86 is such as both slots can receive, at the same time, the upright flange on the front and back support rails 52 and 54. When thus engaged, the rod 74 cannot be canted to be inadvertently released from the front and back support rails.

Rod 92, seen in FIGS. 3, 4 and 5, comprises upper rod 94 of preferably square cross section and which may be made of wood. End caps 96 and 98 are in the form of narrow channels which are cut to the same cross section as the rod 94 and are attached to the ends of the rod 94 to define downwardly directed slots. Slot 100 is shown on the near cap 98, as seen in FIG. 4. The slots in the caps are spaced so as to receive therein the upper flange of the front and back support rails, as seen in FIG. 3. The end cap may be secured in place by means of a screw passing through a clearance hole on the outer flange and engaging against the inner flange to secure the cap against the end of the rod. Lower rod 102 is attached to the underside of upper rod 94 by a spring and hook arrangement, the same as the attachment of the lower rod 78 under upper rod 76. In this way, the end of lower rod 102 may be freed from its hook to be made accessible.

FIGS. 4 and 6 show rod 104, which is another preferred embodiment of support rod structure. Rod 104 is quite similar to rod 70, except that it has a slot 106 partway through adjacent each end thereof. The front and back support rails are also of slightly different configuration, with front support rail 108 shown in FIG. 6. The support rail 108 has an upright flange 110 and a horizontal flange 112, corresponding to the flanges 66 and 68. In addition, it has a hook flange 114 which extends upward at the inner edge of horizontal flange 112. Thus, the front and rear support rails are each channels, with the flanges closer together being the shorter flanges. Rod 104 is used in pairs, and the distance between its slots corresponds to the distance between the hook flanges 114. In use, the rod 104 and its companion rod are engaged on these hook flanges to hook them securely in place so they do not inadvertently drop within rack 46.

Each of the laundry bags is the same. The laundry bag 14 is shown in FIGS. 1 and 2 and is, thus, best seen. Each of the laundry bags has sides, ends and bottom to define an open-mouth bag. Each of the bags is formed of a washable, wear-resistant and non-shrink material. In order to hang the bags from the rods, hanger straps are formed by looping the bag material at the top to form a hanger loop which will receive any one of the support rods. Bag 14 is shown in FIG. 7, and loop 116 is formed at the top edge thereof to form a loop opening through which a hanger rod can be inserted. The suspension sleeve formed by loop 116 has a suitably folded and hemmed outer end to facilitate the insertion of the rod through the suspension sleeve. Hanger rod 70 is shown as being inserted through loop 116, and hanger rod 72 is shown as being inserted through loop 118, as seen in FIG. 1. These hanger rods are carried on the front and back support rails. The length of the support rails is such as to permit the support of from two to six bags, preferably about four. The laundry bags can be of different color so as to readily identify the bags during sorting and the type of contents thereof when laundering is desired. With this construction, with any of the support rods, it is seen that the rods slide along the support rails permitting enlarging and narrowing to provide self-adjusting bag mouth openings and to permit multiple bags to be suspended.

When the plurality of bags is such that the bags are contiguous to define immediately adjacent bag openings, the separation of laundry into separate categories is facilitated for ease of sorting laundry into like kinds of materials, colors and washing characteristics. Of course, the cover 64 is open during the act of sorting, but may be closed between sortings to keep dust out of the bags and to enhance the appearance. When sorting is completed and one or more bags are to be taken to the laundry, the selected bags are removed from the frame. The bags have a sewn-on handle loop 120 on one edge thereof oriented in a horizontal direction. On the other edge thereof, they have a handle loop oriented in the vertical position, such as handle loop 122 shown in FIG. 2. By means of these handle loops, the bags are lifted or carried. In the case where they are engaged on lower rods such as rods 78 and 102, the near end of the laundry bag is lifted, each lower rod is disengaged from its hook, and the entire bag is drawn forward through the open front of the frame by the handle loop. The horizontal handle 120 aids in drawing the laundry bag off of its support rod. In the case of supporting the laundry bags on rods such as rods 70 and 104, the rods are disengaged from the front and back support rails 52 and 54 by canting rods right or left, and the laundry bag, with its rods in place, is withdrawn out of the front of the frame or lifted up out of the frame. If desired, the rods can be removed when it is desired to wash a laundry bag, or may be left in place.

The vertically oriented handle loop 122 is positioned so that the carrying of the laundry bag can be comfortably accomplished in one hand. As seen in FIG. 2, the laundry bags are of such length as to almost reach the floor of the frame. The suspension of the laundry bags permits free hanging of the bags, which in turn permits sliding of the bags along their front and back support rails to open and close the mouths of selected bags. Once the laundry bag is at the machine, handle loop 124 attached to the bottom can be used to invert the laundry bag for ease in dumping of its contents into the laundry machine. In this way, the emptying of the entire contents of the bag into the washing machine is facilitated.

This invention has been described in its presently contemplated best modes, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A plurality of laundry bags together with a frame apparatus comprising:

a plurality of laundry bags, each of said laundry bags having a mouth and having loops adjacent said mouth of said laundry bag;

said frame apparatus having first and second spaced support rails;

a pair of upper rods and a pair of lower rods hanging dependent from said upper rods, said lower rods extended through said loops on said laundry bag;

said upper rods interengaging with said support rails to support said plurality of laundry bags dependent below said support rails so that said upper rods are movable along the length of said support rails to selectively open and close said mouths of said laundry bags and for adjustment of spacing between said laundry bags, each of said upper rods having first and second ends and having means adjacent said first and second ends for respective interengagement with said first and second support rails to minimize canting of said upper rods with respect to said support rails to prevent said upper rods from being disengaged from said support rails by mere lateral motion along the length of said first and second support rails.

2. The laundry bags and frame apparatus of claim 1 wherein said lower rod is mounted upon said upper rod in such a way that at least one end of said lower rod can be made free so that said loops on said laundry bags can be slid onto and off of said lower rods.

3. The laundry bags and frame apparatus of claim 1 wherein said frame is formed of a floor and a plurality of uprights, said support rails being mounted to be supported by said uprights, said bags being sufficiently long so that when hung from said rods supported on said rails, said laundry bags substantially reach to said floor of said frame.

4. The laundry bags and frame apparatus of claim 3 wherein each of said laundry bags has a handle adjacent its mouth to aid in carrying said laundry bag and has a handle externally mounted on said bottom of said laundry bag so as to aid in emptying said laundry bag.

5. A plurality of laundry bags and a frame apparatus therefore, comprising:

a frame apparatus having a plurality of uprights and means for supporting said uprights in an upright position;

a rack attached to said uprights, said rack having first and second support rails so that said support rails are spaced above the floor, each of said support rails having an upstanding flange;

a plurality of laundry bags, said laundry bags each having an open mouth and a closed bottom together with closed sidewalls so that clothes sorted into each of said laundry bags is retained therein until the clothes are discharged from said mouth of said laundry bag, said laundry bag having first and second loops on the mouth end of said laundry bag on opposite sides of said mouth;

first and second upper rods, first and second lower rods attached beneath respective said upper rods, said lower rods respectively positioned through said first and second loops of each of said laundry bags, said upper rods each having first and second ends respectively engaging on said first and second support rails, said upper rods engaging said support rails so that said laundry bags can be moved along the length of said first and second support rails to space said bags with respect to each other and said upper rods being movable along the length of said support rails to open and close the mouths of individual bags, said lower rods being withdrawable from said loops in said bags to individually move said laundry bags away from said frame, said first and second ends of said upper rods each respectively having a first and second slot adjacent said first and second end and spaced to respectively engage over said upstanding flanges of said support rails.

* * * * *